US005938332A

United States Patent [19]

Bachellier

[11] Patent Number: 5,938,332

[45] Date of Patent: Aug. 17, 1999

[54] MIXING DEVICE

[76] Inventor: Carl R. Bachellier, 10 Watsons Lane, Dundas, Canada, L9H 1T3

[21] Appl. No.: 08/958,563

[22] Filed: Oct. 27, 1997

[51] Int. Cl.[6] ..... B01F 7/16

[52] U.S. Cl. ..... 366/330.1; 366/343

[58] Field of Search ..... 366/129, 197, 366/199, 262, 270, 325.1, 330.1, 330.2, 330.3, 330.4, 330.5, 330.6, 330.7, 342, 343; 241/168, 169.1, 291, 293, 294

[56] References Cited

U.S. PATENT DOCUMENTS

| | | | |
|---|---|---|---|
| 444,345 | 1/1891 | Gabbett . | |
| 589,946 | 9/1897 | Grunow . | |
| 636,400 | 11/1899 | Friedman . | |
| 662,525 | 11/1900 | Davidson . | |
| 949,150 | 2/1910 | Kestner . | |
| 950,152 | 2/1910 | Gaar | 366/197 |
| 1,165,931 | 12/1915 | Akimoff . | |
| 1,321,378 | 11/1919 | Kohn . | |
| 1,568,946 | 1/1926 | Generich . | |
| 2,008,106 | 7/1935 | Lawrence | 366/197 |
| 2,753,162 | 7/1956 | Conley . | |
| 2,769,623 | 11/1956 | Cawood . | |
| 2,779,574 | 1/1957 | Schneider . | |
| 3,295,997 | 1/1967 | Tomlinson et al. | 366/197 |
| 3,333,831 | 8/1967 | Chapman | 366/343 |
| 3,811,978 | 5/1974 | Wooden . | |
| 4,004,786 | 1/1977 | Stephens | 366/330.7 |
| 4,264,276 | 4/1981 | Massey . | |
| 5,314,310 | 5/1994 | Bachellier . | |

FOREIGN PATENT DOCUMENTS

| | | |
|---|---|---|
| 1196567 | 5/1959 | France . |
| 872198 | 2/1953 | Germany . |
| 819029 | 8/1959 | United Kingdom . |

*Primary Examiner*—Tony G. Soohoo
*Attorney, Agent, or Firm*—Rogers & Scott

[57] ABSTRACT

The invention provides a mixing impeller for full immersion in a liquid to mix the liquid. The impeller has a central, longitudinally-extending axis of rotation, and includes a unitary body having a circular area disposed radially about the axis of rotation. A plurality of similar coplanar radial extensions extend from the circular area and are spaced equally about the area defining similar radial discharge slots between adjacent pairs of the extensions. A plurality of blades are cantilevered from the extension and extend axially and outwardly from the extensions, such that the body expands generally conically from the circular area along the lengths of the blades. Each blade has a leading edge, a trailing edge and an end edge remote from the associated radial extensions with the leading edge positioned radially inside the trailing edge such that as the impeller rotates in the liquid reservoir, liquid will be inspired to flow upwardly into the body towards the circular area before discharging through gaps between the blades and through the radial slots. A coupling is attached to the circular area of the impeller for connecting the impeller to a drive shaft.

11 Claims, 4 Drawing Sheets

MIXING DEVICE

FIELD OF INVENTION

This invention relates to devices for mixing liquids and more particularly to a mixing impeller used in such devices and which is especially useful for mixing smaller quantities of liquids such as those found in drum containers.

BACKGROUND OF THE INVENTION

Many liquids are used commercially and stored in various containers ready for use. The liquids can be mixtures of liquids having different densities so that they will tend to settle one from another, and also liquids which contain fine particulates which will settle out of the liquid if left for long periods of time. It is therefore necessary to provide some form of mixing so that the liquids will be homogeneous at the time that they are required for use, for instance, in an industrial process.

Various forms of apparatus have been provided for mixing liquids and these include devices to shake or rotate the container of liquid, as well as intrusive devices which are placed in the liquid and caused to vibrate or rotate in the liquid. Such devices must meet a number of design criteria. First of all, because the cost of mixing is directly related to the horsepower consumed in performing the operation, the mixing should be done efficiently to keep the costs down. Also, because it may be necessary to minimize the time of mixing to match the requirements of a continuous process, the actual time used for mixing becomes important.

The present invention is of the intrusive type intended to be placed in the liquid and caused to rotate to create flow within the liquid which will result in mixing.

In some mixing applications, an intrusive impeller must be entered through an opening in a container. An example of this would be liquid in a drum. The impeller has to be engaged through the opening or "bung hole" of the drum. Some attempts have been made to do this using impellers which consist essentially of a folding propeller. The opening in the drum is quite commonly near the wall of the drum and consequently the propeller must be placed away from the wall to avoid contact when the propeller is driven; the structure which drives the propeller must be supported such that the propeller will not drive itself into the wall.

Another form of mixing impeller can be found in U.S. Pat. No. 5,314,310 to Bachellier. In this patent, a rather complex welded structure has a generally frusto-conical body having blades which are angled and welded in place in a frame. The structure is complicated and is more suitable for larger impellers rather than for the smaller variety used in drums and the like.

In general, prior art impellers used for mixing liquids tend to be complex and expensive to manufacture, especially in smaller sizes. Also, complex structures tend to have places where material can collect making such structures difficult to keep clean and therefore unsuitable for use in some industries, notably the food industry.

It is therefore an object of the present invention to provide a simplified impeller which is relatively inexpensive to manufacture and which is suitable for mixing smaller volumes of liquids such as those found in drums and other containers, and to provide efficient mixing.

SUMMARY OF THE INVENTION

In accordance with one of its aspects, the invention provides a mixing impeller for full immersion in a liquid to mix the liquid. The impeller has a central, longitudinally-extending axis of rotation, and includes a unitary body having a circular area disposed radially about the axis of rotation. A plurality of similar coplanar radial extensions extend from the circular area and are spaced equally about the area defining similar radial discharge slots between adjacent pairs of the extensions. A plurality of blades are cantilevered from the extension and extend axially and outwardly from the extensions, such that the body expands generally conically from the circular area along the lengths of the blades. Each blade has a leading edge, a trailing edge and an end edge remote from the associated radial extensions with the leading edge positioned radially inside the trailing edge such that as the impeller rotates in the liquid reservoir, liquid will be inspired to flow upwardly into the body towards the circular area before discharging through gaps between the blades and through the radial slots. A coupling is attached to the circular area of the impeller for connecting the impeller to a drive shaft.

BRIEF DESCRIPTION OF THE DRAWINGS

The invention will be described with reference to the following description taken in combination with the drawings, in which.

Figure 1:
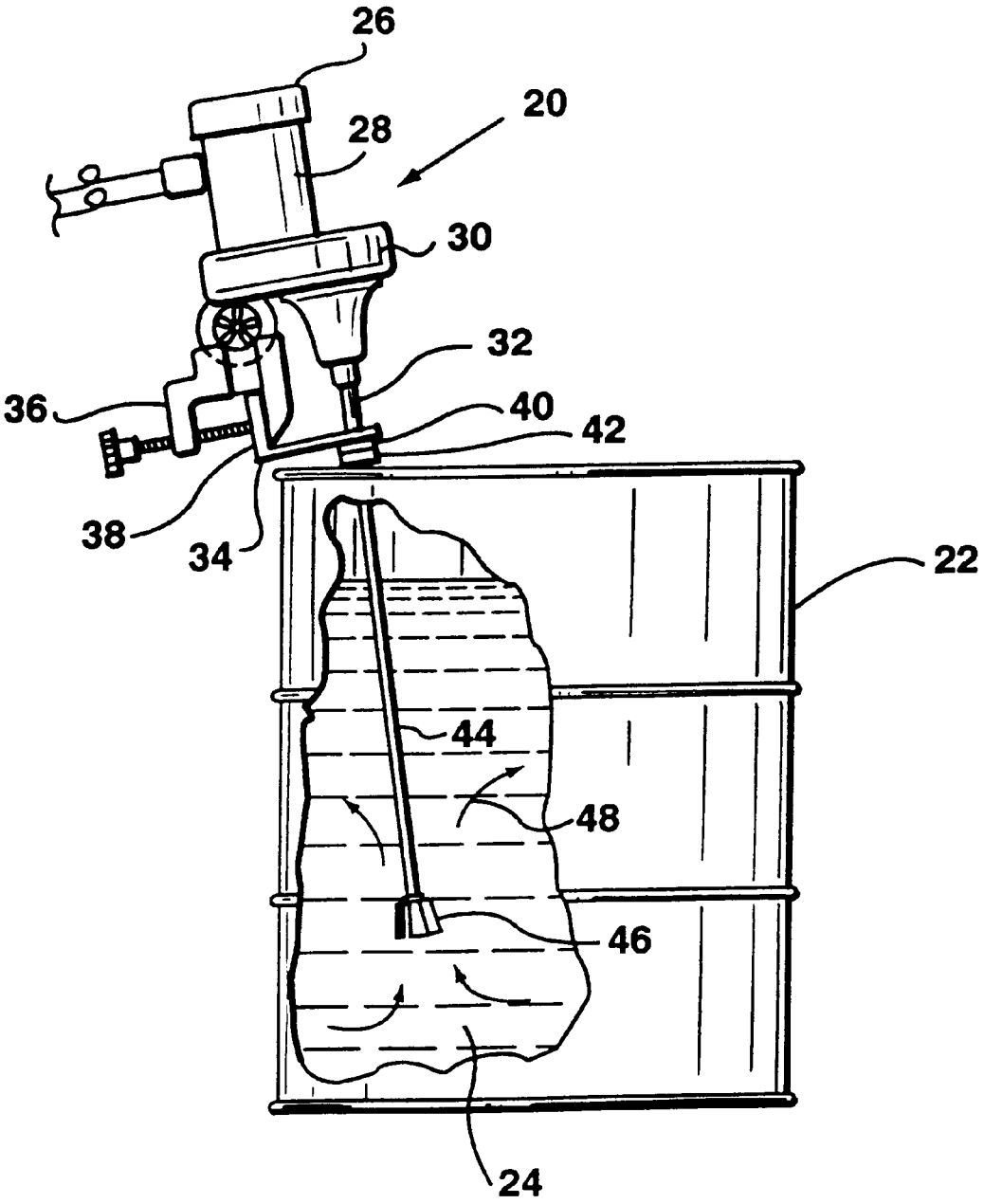
FIG. 1 is a side view, partially broken away, to show a preferred embodiment of impeller according to the invention in use with a mixing device mounted on an exemplary drum to mix liquid in the drum.

Reference is first made to FIG. 1 to describe the general use of a mixing impeller according to the invention and shown in an exemplary use to mix the contents of a standard drum. A mixing device designated generally by the numeral 20 is mounted on a drum 22 for mixing liquid 24 contained in the drum. The device 20 includes a drive unit 26 connected to an electrical power source (not shown) and including a motor 28, leading to a gear box 30 which in turn drives an output shaft 32. The drive unit is mounted on a bracket 34 by a conventional clamp 36 and the bracket is generally L-shaped including an upright portion 38 to which the drive unit is attached, and an extension 40 extending generally horizontally and connected to a threaded coupling 42. This coupling engages in the conventional threaded bung hole of the drum 22 and also provides a connection between the output shaft 32 and an impeller drive shaft 44 which carries an impeller 46 as will be described.

In operation, when the drive unit 26 is actuated, the drive shaft 32 will rotate taking with it the impeller 46 and this rotation will cause mixed flow of liquid locally which will then mix the liquid in the drum. The flow is indicated by arrows 48 and it will be evident that the upward flow will result in drawing liquid from the bottom of the drum and creating a circular flow as the liquid enters the impeller. The flow is aggressive and creates a forced vortex which has both radial and axial components. This enhances the flow rate and results in breaking stratified layers at the surface while processing rapid and efficient mixing throughout the drum. It will be appreciated that the shaft 32 can be mounted to be at various angles to the vertical, but the impeller 46 is best positioned nearer the centre of the drum 22 to create a mixing pattern throughout the drum.

The structure of the impeller and its manufacture will be described followed by further description of the use of the impeller, with particular reference to exemplary use in association with the drum 22.

The impeller 46 will now be described with reference initially to FIG. 2 where it can be seen that the impeller includes a unitary body 50 which is to be welded to an annular boss 52 to provide for attachment to the lower end of the impeller drive shaft 44. The boss 52 defines a central circular opening 54 to receive a lower end of the shaft 44 and the impeller is then secured to the shaft by a set screw 56 which engages in a complimentary threaded aperture 58 to bear against the shaft 44.

The opening 54 is aligned with an opening 60 in the upper part of the body to permit alignment of the parts while the annular boss is welded to the unitary body 50. A circular area or annulus 62 is located about the opening 60 and the annulus extends orthogonally with respect to a central axis 64. (Ghost outline 66 is included in the drawing to better identify the annulus 62). This annulus supports a plurality of coplanar radial extensions 66 which are equally spaced about the annulus, there being five in the preferred embodiment. Adjacent pairs of extensions 66 combine to define radially extending discharge slots 68 which accommodate some of the flow out of the impeller as will be described.

The radial extensions 66 terminate at compound bends 70 where the flat extensions 66 meet respective cantilevered curved blades 72. The bends 70 are compound (i.e. three dimensional) due to the fact that the blades are inwardly concave and meet a flat surface so that the bend can not be a straight line bend. Each of the blades extends axially and outwardly downwards (as drawn) lying in a generally conical arrangement as will be more fully described with reference to FIG. 3. For the moment it is sufficient to understand that each of the blades includes an axially extending leading edge 74 (four of which can be seen in FIG. 2) and a trailing edge 76. The leading edges 74 are connected to the corresponding trailing edges 76 by end edges 78 which lie generally in a plane parallel to a plane containing the annulus 62, the extensions 66 and the major parts of the compound bends 70. Also there are axial gaps 79 (FIG. 2) between adjacent pairs of blades.

To better understand the arrangement of the blades, each of the blades is concave facing inwardly and is narrowest at the corresponding compound bend 70. The blade is widest at the end edge 78 and in the preferred embodiment the curvature of the blades is such that if the blades were separated from the structure and placed side by side, they would form the frustum of a cone with the bottom edges 78 forming a circle and the respective leading and trailing edges 74, 76 abutting respective trailing and leading edges of adjacent blades.

Figure 2:
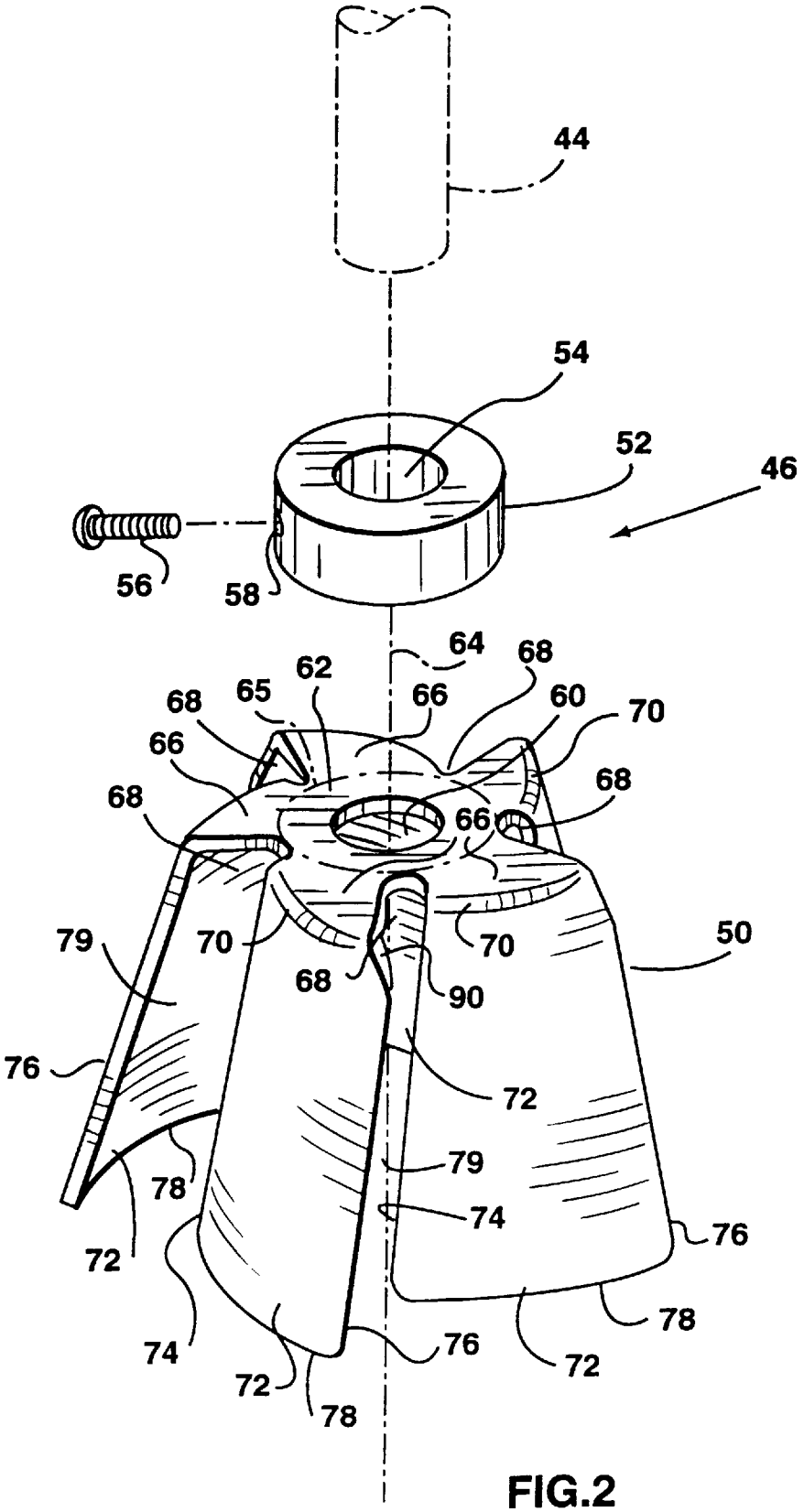
FIG. 2 is an exploded isometric view of the impeller drawn to a larger scale to better illustrate a unitary main body of the impeller.

It will be evident from FIG. 2 that the arrangement of the blades is such that when the impeller is rotated with the leading edges 74 ahead of the trailing edges, 76, liquid will be directed outwardly through gaps 79 with the greatest velocity being at the lower parts of the blades where they travel fastest. The resulting decrease in pressure near the open bottom of the impeller inside the blades will cause the liquid to move axially upwards before leaving via the gaps 79 between the blades and via the radial slots 68. As the liquid moves upwardly, it will take on a local rotation with resulting mixed flow which both enhances flow and mixing thereby creating an efficient mixing process. Also, there is little likelihood of air entrainment because, even with part of the impeller above the liquid, the flow is from below. This is an important consideration when mixing liquids such as paints to be used in spray guns quite soon after mixing.

Figure 3:
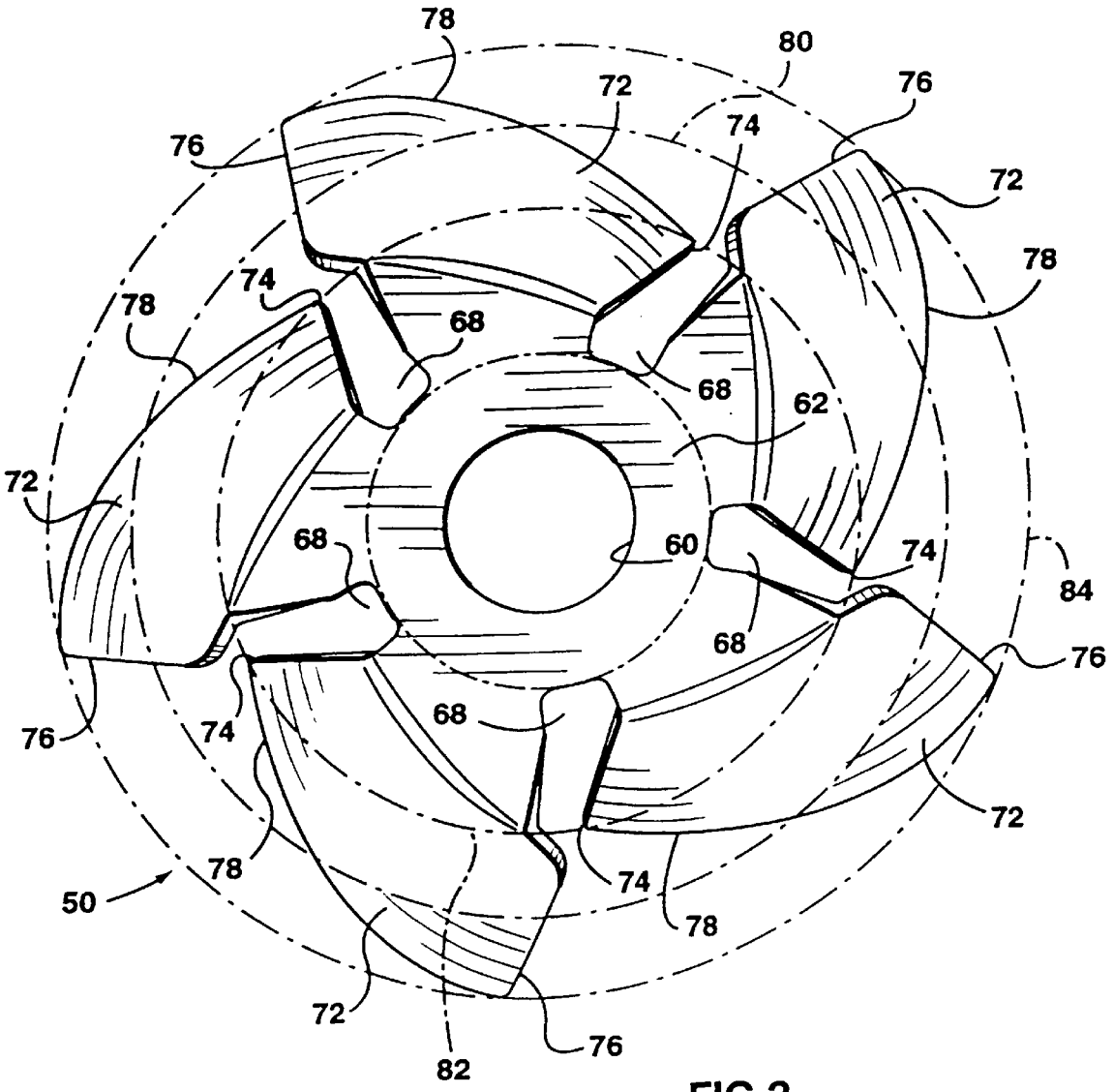
FIG. 3 is a top view of the main body of the impeller and drawn to a larger scale than that shown in FIG. 2.

As seen in FIG. 3, the unitary body 50 has the blades 72 angled tangentially with respect to an imaginary circle 80 drawn through the midpoints of the end edges 78 of the blades. Consequently, the leading edges terminate at an inner circle 82 whereas the outer edges terminate at a larger outer circle 84. This angular relationship of the blades combines with the generally conical arrangement to drive liquid outwardly and axially upwards and the resulting mixed flow meets liquid in the container and causes efficient mixing of liquid.

It will be evident that the outer circle 84 represents the overall diameter of the impeller and consequently the impeller can be passed through any opening that is larger than this circle.

Figure 4:
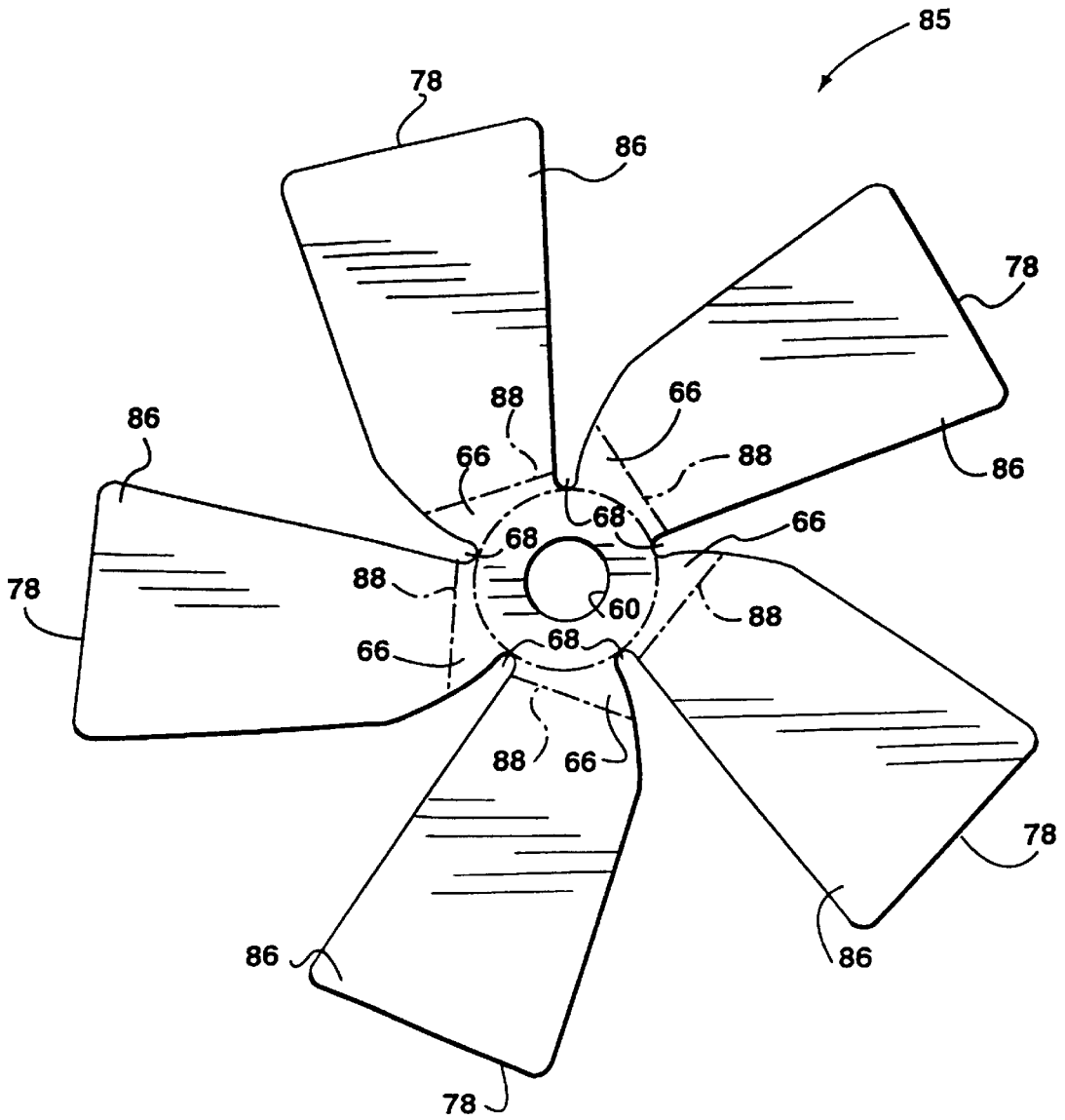
FIG. 4 is an outline of a blank used as a pre-form to make the main body of the impeller.

Reference is next made to FIG. 4 which illustrates the outline of a blank 85 used as a pre-form to make the integral body of the impeller. The annulus 62 can be seen at the centre of FIG. 4 together with the radial extensions 66. These parts retain their respective relationships as shown in FIG. 4 as the blades are formed by bending into the plane of the paper. The forming process takes place between a male die having a forward surface corresponding to the surface defined by the annulus 62 and the projections 66, and a female die which has a complementary shape to create the compound bends 70 (FIG. 2) and to also put curvature into flat blades 86 to form blades 72 (FIG. 3).

As also seen in FIG. 4, chain dotted lines 88 indicate the general position of the compound bends which will take a rounded formation to accommodate the transition between the flat radial extension 66 and the curvature of the blades. This leads to a natural curvature which will be described now with reference to FIG. 2. It will be seen on the foremost one of the blades 72 that the trailing edge 76 meets the extension 66 at a point of curvature indicated generally by the numeral 90. This curvature is somewhat exaggerated in FIG. 2 to indicate its position but it is an attribute of the unitary body 50. The curvature 90 is located where the liquid exits so that it reduces the risk of breaking up the inherent vortex flow. Also, because flow passes this portion continuously, there will be little likelihood of trapping material so that the impeller tends to be self-cleaning.

Returning to FIG. 4, it will be appreciated that the annulus 62 and extensions of the blank are separated from the pre-forms 86 of the blades at the chain-dotted bend lines 88. These indications of where the bending will take place extend generally tangentially to the annulus 62 at a location adjacent the discharge slots 68 and parallel to the respective end edges 78.

It will be evident that the unitary body 50 FIG. 1) can be of limited size. This is because the net load on the cantilevered blades in use will tend to deflect the blades radially inwards. The material of the body and the shape of the blades combine to resist this. However, a point will clearly be reached where the size and speed will be such that the impeller will no longer be viable.

It has been found that the ratio of the length of the blades to the diameter of circle 80 (the mean diameter) is preferably about 0.75 to achieve a steady vortex. This seems to be a characteristic of a smaller impeller of this type where it has been found that if the vortex is incomplete, an internal interference pattern can result at the entry and there will then be backwash through the intake diameter inside the blades accompanied by stalling. This breaks the steady flow state.

It has also been found that the tangential angle of the blade measured with respect to the circle 80 (FIG. 3) should not be below 22 degrees and should not exceed 32 degrees. At a lower blade angle, the impeller provides negligible flow rates whereas if the angle is too great, an unstable mixed flow occurs at the periphery of the blade element. Losses would result and the impeller would become inefficient.

The number of blades is preferably five but it is anticipated that the number of blades could be as small as three and as high as fifteen. However, with a larger number of blades, the effective surface areas of the individual blades would decrease thus decreasing the overall efficiency of the mixer.

Impellers according to the invention will be less than about 2.5 inches in maximum diameter. With an impeller of 2.25 inches it has been found that diameters of container greater than 36 inches result in poor mixing. As a rule, the vessel should have a diameter no greater than about 15 times that of the mean diameter of the impeller.

With regard to viscosity, impellers of this type have been used in viscosities ranging from 1 (water) to 10,000 centipoise, although the best application will be in the range of 100 to 1500 centipoise. These figures are in the speed range of 25 to 3000 RPM with the ultimate range being 150 to 1750 RPM.

The integral body is preferably made of stainless steel using either 316 L (low carbon stainless steel) or 304 L.

The impeller has numerous uses. One example will be described with reference to FIG. 1. The impeller 46 (FIG. 1) and associated shaft 44 are first assembled and connected to the coupling 42 on the bracket 34. Next the resulting sub-assembly is mounted on the drum with the shaft 44 extending downwardly to locate impeller 48 at a point about 25% of the height of the drum. This step is facilitated by the thread on the bung hole which accommodates a similar thread provided on the coupling 42.

Next the drive unit 26 is attached to the bracket 34 so that when the unit 26 is activated the impeller 46 will be made to rotate. The result will be a vigorous mixed flow which will inspire circulation in the remainder of the barrel. This will bring into play a combination of flows tending to move liquid throughout the barrel and feed liquid through the impeller. The result is an efficient and effective mixing operation.

As previously mentioned, the impeller is particularly useful when mixing liquid in barrels because a unitary body of 2.25 inches will fit through the bung hole. The body is relatively inexpensive, free of dead spaces which would collect debris, and also efficient in use.

The invention as claimed includes all embodiments falling within the inventive concept.

I claim:

1. A mixing impeller for fill immersion in a liquid to mix the liquid, the impeller having a central, longitudinally-extending axis of rotation and comprising:

a unitary body including a circular area disposed radially about the axis of rotation, a plurality of similar coplanar radial extensions extending outwardly from the circular area and spaced equally about the area, the radial extensions defining similar radial discharge slots between pairs of the radial extensions, a plurality of curved blades cantilevered from the respective extensions and extending axially and outwardly, so that the body expands generally conically from the circular area along the lengths of the blades, each blade having a leading edge, a trailing edge and an end edge remote from the associated radial extensions with the leading edge positioned radially inside the trailing edge, the blades being shaped so that if placed side-by-side the blades would form a frustum of a cone, so that when the impeller is rotated in the liquid reservoir, a vortex will be inspired in the liquid as the liquid flows axially into the body between the blades and then towards the circular area before discharging through gaps between the blades and through the radial slots; and a coupling attached to the impeller for connecting the impeller to a drive shaft.

2. An impeller as claimed in claim 1 in which the coupling is an annular boss secured to the circular area concentrically about said axis.

3. An impeller as claimed in to claim 1 wherein each radial extension meets the corresponding trailing edge at a curvature to provide greater clearance for flow and to minimize turbulence and cavitation while the impeller is rotating.

4. An impeller as claimed in claim 1 in which mid points of the end edges of the blades lie on a mean diameter and in which the axial lengths of the blades are equal to about 0.75 of the mean diameter.

5. An impeller as claimed in claim 4 in which mid points of the end edges of the blades lie on a mean diameter and in which the blades are angled with reference to the mean diameter at an angle in the range 22 to 32 degrees.

6. An impeller as claimed in claim 4 in which the number of blades is between 3 and 5.

7. An impeller as claimed in claim 1 in which mid points of the end edges of the blades lie on a mean diameter and in which the blades are angled with reference to the mean diameter at an angle in the range 22 to 32 degrees.

8. An impeller as claimed in claim 1 in which the number of blades is between 3 and 5.

9. A mixing device for mixing liquids, the mixing device comprising:

an impeller as claimed in claim 1;

a drive unit; and an impeller shaft coupled to the drive unit, the drive unit being operable to drive the impeller at between 25 and 3000 RPM.

10. A mixing device as claimed in claim 9 in which the impeller is driven at a speed in the range 150 to 1750 RPM.

11. A mixing impeller as claimed in claim 1 in which the impeller has an outside diameter of less than about 2.5 inches.

* * * * *